US012631110B1

(12) United States Patent
Zimdars et al.

(10) Patent No.: US 12,631,110 B1
(45) Date of Patent: May 19, 2026

(54) WIRELESS SINGLE TRIP ABANDONMENT DOWNHOLE TESTING ISOLATION SYSTEM

(71) Applicant: Schlumberger Technology Corporation, Sugar Land, TX (US)

(72) Inventors: Bryan Zimdars, Houston, TX (US); Andrew Vissotski, Rosharon, TX (US); Brian Abbott, Missouri City, TX (US); Chao Wang, Missouri City, TX (US); Kevin Peterson, Houston, TX (US); Vijayendra Mali, Pune (IN)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 19/244,015

(22) Filed: Jun. 20, 2025

(51) Int. Cl.
*E21B 49/08* (2006.01)
*E21B 23/06* (2006.01)
*E21B 47/14* (2006.01)

(52) U.S. Cl.
CPC ..... *E21B 49/087* (2013.01); *E21B 23/06* (2013.01); *E21B 47/14* (2013.01)

(58) Field of Classification Search
CPC ..... E21B 49/087; E21B 23/06; E21B 47/14
See application file for complete search history.

(56) References Cited

U.S. PATENT DOCUMENTS

| | | | | |
|---|---|---|---|---|
| 5,611,401 | A * | 3/1997 | Myers, Jr. | E21B 43/116 175/4.52 |
| 6,478,086 | B1 * | 11/2002 | Hansen | E21B 33/02 166/387 |
| 2015/0204155 | A1 * | 7/2015 | Patel | E21B 33/12 166/360 |
| 2018/0252069 | A1 * | 9/2018 | Abdollah | E21B 33/13 |
| 2019/0178049 | A1 * | 6/2019 | Kræmer | E21B 33/1285 |
| 2019/0292905 | A1 * | 9/2019 | Ross | E21B 47/07 |
| 2021/0131277 | A1 * | 5/2021 | Giordano | E21B 47/16 |
| 2023/0116346 | A1 * | 4/2023 | Dave | E21B 23/06 166/387 |

* cited by examiner

*Primary Examiner* — Theodore N Yao
(74) *Attorney, Agent, or Firm* — Jeffrey D. Frantz

(57) ABSTRACT

The present disclosure provides techniques and apparatus for performing drill stem testing (DST) in a single run. An example technique includes deploying a running tool inside a casing of the wellbore in a single run. The running tool includes a tool string comprising one or more setting tools, one or more testing tools, and a completion packer. The completion packer is triggered to engage with the casing during the single run and via the one or more setting tools. A test of the wellbore is performed to determine one or more wellbore parameters during the single run and via the one or more testing tools.

15 Claims, 6 Drawing Sheets

WIRELESS SINGLE TRIP ABANDONMENT DOWNHOLE TESTING ISOLATION SYSTEM

BACKGROUND

Field of the Disclosure

The present disclosure relates to systems and methods for reservoir testing and evaluation. More specifically, the present disclosure provides techniques and apparatus for performing drill stem testing in a single run into a well.

Description of Related Art

Drill stem testing (DST) is a widely utilized reservoir evaluation method employed in the oil and gas industry to gather critical data about subsurface reservoirs. DST involves the temporary isolation of a section of the wellbore to allow for controlled testing and measurement of reservoir characteristics (or parameters), such as pressure, flow rates, and fluid properties, as illustrative examples. For example, the DST procedure typically involves lowering specialized testing tools into the wellbore, including packers, gauges, and valves, to isolate and evaluate specific reservoir intervals. During testing, measurements of pressure and flow are continuously recorded, providing insights into reservoir behavior under dynamic conditions. These insights enable operators to estimate reserves, understand fluid characteristics, and assess the potential economic viability of reservoir development.

SUMMARY

One embodiment of the present disclosure described herein is a method of testing a wellbore. The method includes deploying a running tool inside a casing of the wellbore in a single run. The running tool includes a tool string. The tool string includes one or more setting tools, one or more testing tools, and a completion packer. The method also includes triggering, during the single run and via the one or more setting tools, the completion packer to engage with the casing. The method further includes performing, during the single run and via the one or more testing tools, a test of the wellbore to determine one or more wellbore parameters.

Another embodiment of the present disclosure described herein is a system. The system includes one or more memories collectively storing instructions, and one or more processors communicatively coupled to the one or more memories. The one or more processors are collectively configured to execute the instructions to cause the system to: operate a running tool inside a casing of a wellbore in a single run, the running tool comprising a tool string comprising one or more setting tools, one or more testing tools, and a completion packer; trigger, during the single run and via the one or more setting tools, the completion packer to engage with the casing; and perform, during the single run and via the one or more testing tools, a test of the wellbore to determine one or more wellbore parameters.

Another embodiment of the present disclosure described herein is a non-transitory computer-readable storage medium. The non-transitory computer-readable storage medium includes computer-executable code, which when executed by one or more processors of a computing system perform an operation. The operation includes operating a running tool inside a casing of a wellbore in a single run. The running tool includes a tool string. The tool string includes one or more setting tools, one or more testing tools, and a completion packer. The operation also includes triggering, during the single run and via the one or more setting tools, the completion packer to engage with the casing. The operation further includes performing, during the single run and via the one or more testing tools, a test of the wellbore to determine one or more wellbore parameters.

The following description and the appended figures set forth certain features for purposes of illustration.

BRIEF DESCRIPTION OF DRAWINGS

Various embodiments in accordance with the present disclosure will be described with reference to the drawings, where like designations denote like elements. Note that the appended drawings illustrate typical embodiments and are therefore not to be considered limiting; other equally effective embodiments are contemplated.

DETAILED DESCRIPTION

Figure 1:
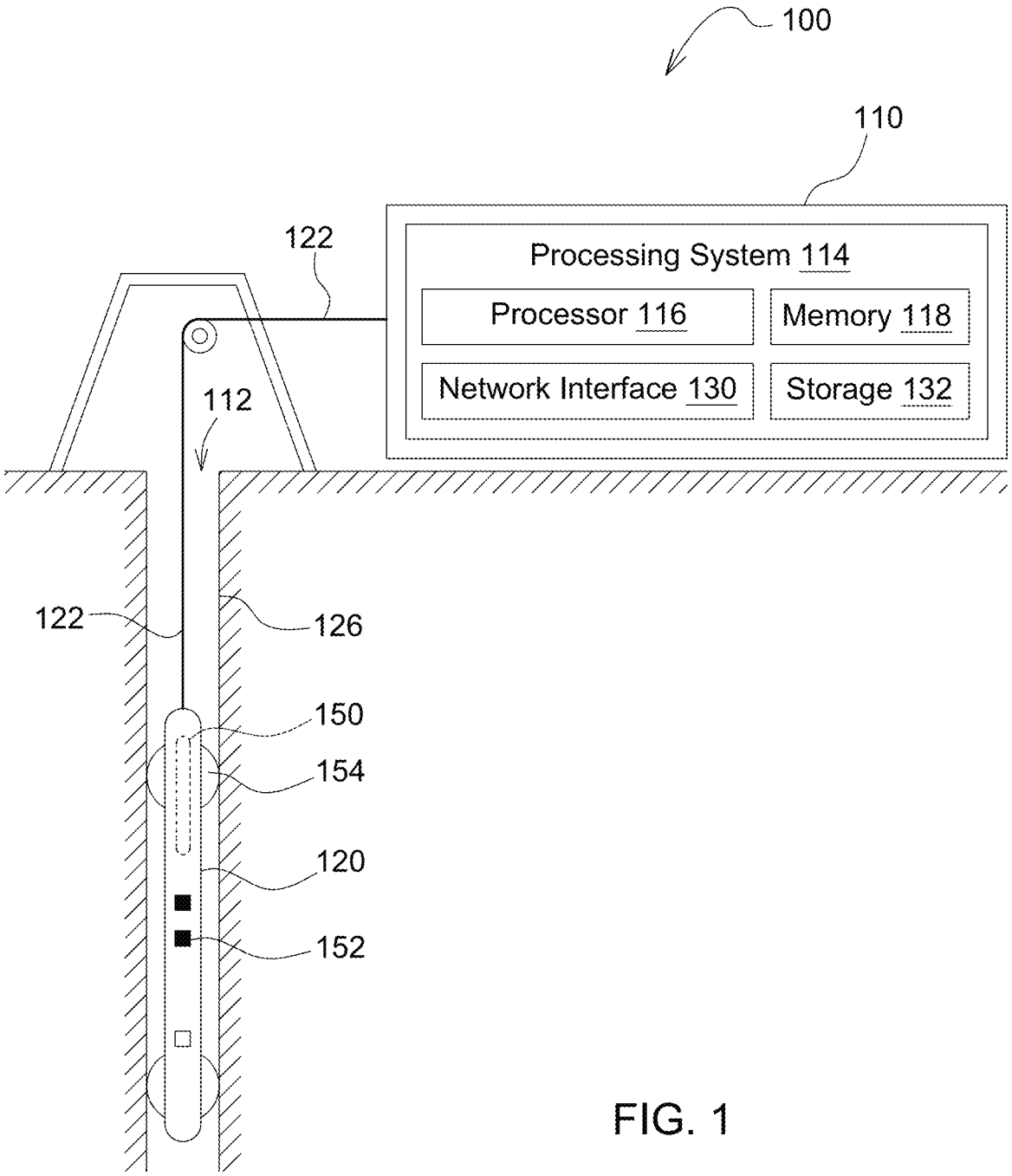
FIG. 1 is a schematic diagram of an example well system, according to certain embodiments.

DST is a dynamic reservoir evaluation technique that is widely used to assess reservoir potential for commercial development decisions at scale. However, despite the widespread adoption and utility of DST, DST continues to face significant challenges related to operational efficiency and cost. A notable factor influencing both the operational duration and associated costs of DST is the length of the buildup period. This period involves downhole gauges monitoring pressure stabilization below a closed tester valve to acquire critical reservoir data. Certain operators have adopted long term monitoring (LTM) with various telemetry technologies to transmit pressure data from downhole locations to the surface during the buildup period as well as after well abandonment post-DST. For example, electromagnetic telemetry has been used as part of LTM due in part to electromagnetic telemetry's ability to transmit data along intact casing strings. Additionally, acoustic wireless telemetry has been used as part of LTM for robust and reliable bidirectional communication with downhole gauges and precise control of DST equipment.

Currently, however, performing DST with LTM generally involves multiple runs into the well to complete the DST process. In the initial run, a running tool deploys tubing conveyed perforating (TCP) guns, a permanent completion packer, LTM gauges, and a wireless isolation valve inside the well. After the packer is set, the running tool is retrieved. In a subsequent run, the remaining DST string is deployed into the well with a seal assembly in order to complete the test. As noted, however, performing DST in this manner with multiple runs can be significantly complex and involve a significant amount of resources in terms of rig time, complex equipment, and cost. Accordingly, there exists a need for further improvements in performing DST.

The disclosure provides techniques, methods, systems, apparatus, and computer-readable media for performing DST in a single run. For example, the disclosure provides techniques for performing a single-run DST operation by integrating an acoustic wireless telemetry hub with a completion packer, allowing the completion packer to be set wirelessly downhole and the DST tools to be actuated in one run. By eliminating the second run typically used in conventional DST procedures to set the packer and retrieving the telemetry hardware, the techniques and apparatus described herein can significantly reduce the amount of rig time associated with performing DST without modifying existing completion packers, thereby maintaining the packer's existing qualifications under American Petroleum Institute (API) standards, such as the API 11D1 standard. Additionally, recovering (or retrieving) the setting mechanism and telemetry hub after the DST can provide a cost-effective, single-trip packer solution that supports long-term monitoring abandonment.

The following description includes embodiments of the best mode presently contemplated for practicing the described implementations. This description is not to be taken in a limiting sense, but rather is made merely for the purpose of describing the general principles of the implementations. The scope of the described implementations should be ascertained with reference to the issued claims.

Although the terms "first," "second," "third," etc., may be used herein to describe various elements, components, regions, layers and/or sections, these elements, components, regions, layers and/or sections should not be limited by these terms. These terms may be only used to distinguish one element, component, region, layer or section from another element, component, region, layer, or section. Terms such as "first," "second," and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

As used herein, a hyphenated form of a reference numeral refers to a specific instance of an element and the unhyphenated form of the reference numeral refers to the collective element. Thus, for example, device "12-1" refers to an instance of a device class, which may be referred to collectively as devices "12" and any one of which may be referred to generically as a device "12".

Example System for Performing Single-Run DST

FIG. 1 is a schematic diagram of at least a portion of an example implementation of a well system 100 for performing single-run DST, according to certain embodiments. In certain embodiments, the well system 100 is located in a land-based operating environment (e.g., onshore). In other embodiments, the well system 100 is located in a water-based operating environment (e.g., offshore), including deepwater development of oil reservoirs. Furthermore, although certain embodiments are described herein with respect to oil and gas exploration and production settings, it should be noted that embodiments described herein can be used in other settings, such as water reservoirs.

In the depicted system, a wellbore (or borehole) 112 is drilled in a subsurface formation(s). As noted, the subsurface formation(s) can be located onshore or offshore. The wellbore 112 generally includes a combination of fluids, such as water, mud, formation fluids, etc. An inspection tool 120 (also referred to herein as a tool string) may be lowered into the wellbore 112 using various methods, including a logging cable (or wireline) 122 and coiled tubing, as illustrative examples.

A surface assembly 110 is situated at the well site with the wellbore 112. The surface assembly 110 may be representative of a variety of surface apparatuses, including a (offshore) platform, a vehicle, a derrick, and rig, as illustrative examples. The surface assembly 110 may be electrically and communicatively coupled to the inspection tool 120 via the logging cable 122. In the depicted example, the surface assembly 110 includes a processing system 114, which is generally configured to control operation and/or functionality of the inspection tool 120 to perform DST in a single run.

The processing system 114 is generally representative of a variety of computing systems, such as laptops, servers, desktops, and mainframes, as illustrative examples. In certain embodiments, the processing system 114 (including one or more components therein) is located in (or otherwise accessible via) a cloud computing environment. The processing system 114 may be implemented using hardware, software, or a combination of hardware and software. As shown, the processing system 114 includes, without limitation, a processor 116, a memory 118, a network interface 130, and a storage 132. The processor 116 represents any number of processing elements, which can include any number of processing cores. The memory 118 can include volatile memory, non-volatile memory, and combinations thereof. The memory 118 generally includes program code for performing various techniques described herein for performing DST in a single run via the inspection tool 120. The program code is generally described as various functional "components" or "modules" within the memory 118, although alternate implementations may have different functions or combinations of functions.

The network interface 130 may include circuitry for communicating over a network (not shown), including wired networks, wireless networks, or a combination thereof. In certain embodiments, the network interface 130 includes a surface wireless telemetry module capable of communicating with a downhole wireless telemetry module. In some such embodiments, the surface wireless telemetry module and the downhole wireless telemetry module may support multiple telemetry technologies, including electromagnetic telemetry and acoustic wireless telemetry, as illustrative examples.

The storage 132 is generally representative of one or more storage systems (e.g., databases) configured to store information associated with reservoir testing. For example, the storage 132 may store reservoir characteristics (or parameters), such as pressure, flow rates, temperature, permeability, and fluid properties (including fluid type), as illustrative examples. The storage 132 may be implemented using hardware, software, or a combination of hardware and software. In certain embodiments, the storage 132 is located in (or otherwise accessible via) a cloud computing environment.

Although not shown, the processing system 114 may also include a human machine interface (HMI). The HMI may include one or more input and/or output devices for enabling communication between the processor 116, the memory 118, the network interface 130, the storage 132, and one or more users. In certain embodiments, the HMI includes one or more input devices, one or more output devices, or a combination thereof. For example, the HMI may include a display and/or a keyboard, a mouse, a touch pad, or other input devices suitable for receiving inputs from a user. In certain embodiments, the HMI includes a touch-screen display (e.g., touch screen liquid crystal display (LCD)), which may enable users to interact with a user interface of the processing system 114.

In certain embodiments, the inspection tool 120 is operated, via the processing system 114, to perform reservoir testing, including DST, as an illustrative example. For instance, the inspection tool 120 can be operated (or controlled) to test earth formations and analyze the composition of fluids that are extracted from a formation and/or wellbore 112. The inspection tool 120 may include an elongated body encasing a variety of electronic components and modules, mechanical components and modules, or a combination thereof. In the depicted well system 100, the inspection tool 120 includes, without limitation, one or more setting tools 150, one or more testing tools 152, and one or more completion packers 154. The setting tools 150, testing tools 152, and completion packers 154 described herein may allow for operating the inspection tool 120 to perform DST in a single run, as described further herein.

The setting tool(s) 150 is generally operable for triggering the completion packer(s) 154 to engage with a casing 126 of the wellbore 112. For example, in certain embodiments, the setting tool 150 includes a wireless telemetry module that is configured to wirelessly trigger the completion packer(s) 154 to engage with the casing 126. The engagement of the completion packer 154 with the casing 126 seals off or isolates selected portions (or zones) of the wellbore 112.

The testing tools 152 may include equipment that allows for conducting tests of reservoir parameters, such as pressure, flow rates, and fluid properties, as illustrative examples. Such equipment may include, for example, a seal assembly, polished bore receptacle (PBR), isolation valves, LTM telemetry modules, among others. Note, the inspection tool 120 is described in greater detail herein with respect to FIGS. 3A-3C.

Figure 2A:
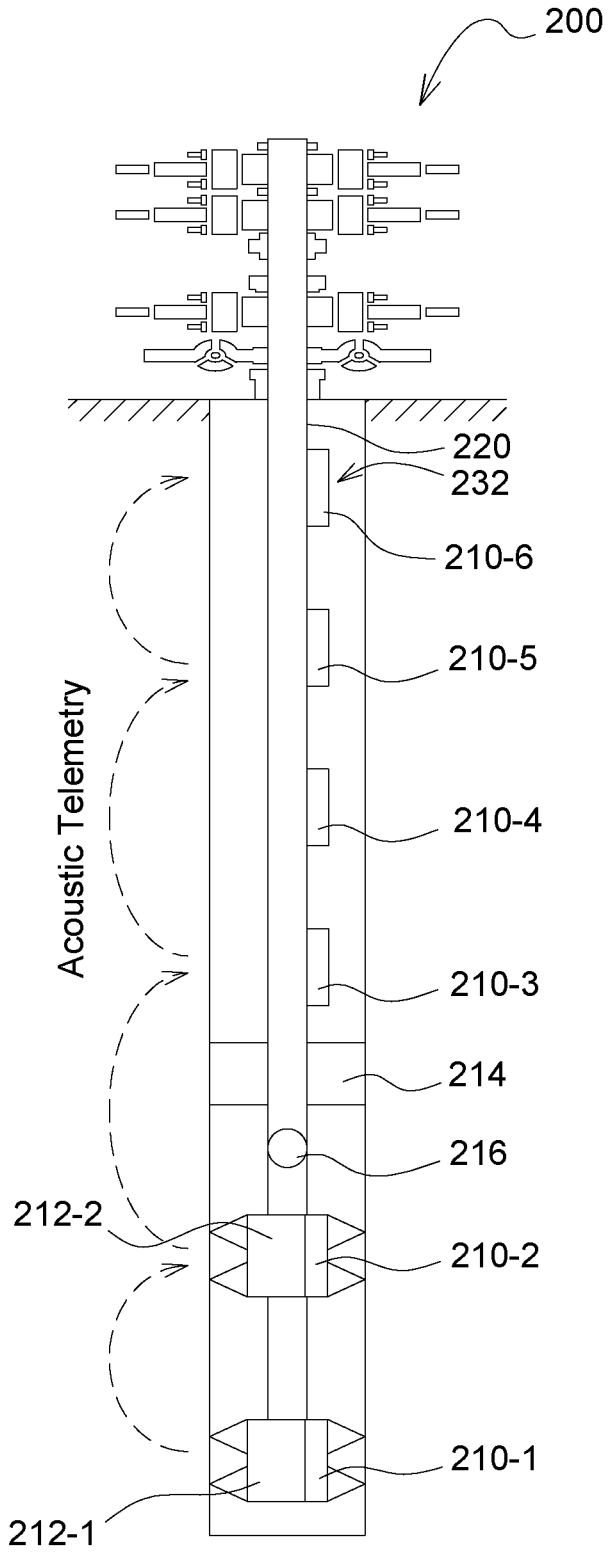
FIG. 2A is a schematic diagram illustrating an example well system configured for long term monitoring (LTM) during a DST phase, according to certain embodiments.
Figure 2B:
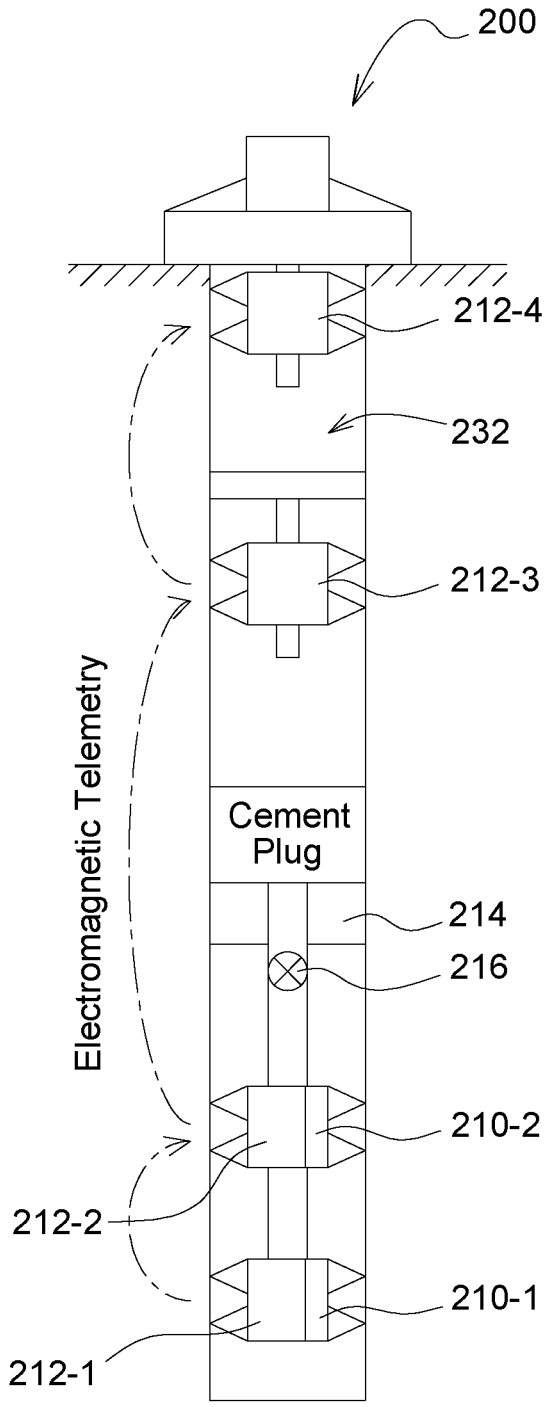
FIG. 2B is a schematic diagram illustrating an example well system configured for LTM during a plug and abandonment (P&A) phase, according to certain embodiments.

As noted, in certain embodiments, the inspection tool 120 supports LTM with multiple telemetry technologies. FIG. 2A is a schematic diagram illustrating a well system 200 configured for LTM during a DST phase and FIG. 2B is a schematic diagram illustrating the well system 200 configured for LTM during a plug and abandonment (P&A) phase (e.g., post-DST), according to certain embodiments. The well system 200 is an illustrative implementation of the well system 100 depicted in FIG. 1.

As shown in FIG. 2A, during a DST phase, an inspection tool 220 is run into a wellbore 232. The inspection tool 220 may be an illustrative implementation of the inspection tool 120 illustrated in FIG. 1. The inspection tool 220 includes one or more acoustic telemetry modules 210-1 to 210-6, one or more electromagnetic telemetry modules 212-1 to 212-2, a completion packer 214, and a wireless isolation valve 216 run into a wellbore 232. In the illustrated example, the acoustic telemetry module 210-1 may be coupled to electromagnetic telemetry module 212-1, and the acoustic telemetry module 210-2 may be coupled to electromagnetic telemetry module 212-2. The acoustic telemetry module 210-1 and the electromagnetic telemetry module 212-1 may form a first LTM module, and the acoustic telemetry module 210-2 and the electromagnetic telemetry module 212-2 may form a second LTM module. Note, however, that an LTM module may include (or refer to) an acoustic telemetry module 210, an electromagnetic telemetry module 212, or a combination of an acoustic telemetry module 210 and electromagnetic telemetry module 212.

During the DST phase, acoustic wireless telemetry may be used to set the completion packer and perform DST in a single run. For example, acoustic wireless signals may be transmitted from a surface assembly 110 to the acoustic telemetry modules 210. In certain embodiments, the acoustic telemetry modules 210-4 to 210-6 may be used to repeat the acoustic wireless signals transmitted from the surface to acoustic telemetry modules 210-1 to 210-2 located further downhole and/or acoustic wireless signals transmitted from the acoustic telemetry modules 210-1 to 210-2 to the surface.

After the DST phase is completed, the inspection tool 220 may be retrieved, leaving the electromagnetic telemetry modules 212-1 and 212-2, the acoustic telemetry modules 210-1 and 210-2, the wireless isolation valve 216 and the completion packer 214 in place. As illustrated in FIG. 2B, during the P&A phase, the well system 200 may be plugged (e.g., by inserting barriers into the wellbore at various depths). During this P&A phase, electromagnetic telemetry may be used to perform LTM. For example, electromagnetic signals may be communicated between the surface assembly 110 and the electromagnetic telemetry modules 212. In certain embodiments, the electromagnetic telemetry modules 212-3 and 212-4 may be used to repeat the electromagnetic signals transmitted from the electromagnetic telemetry modules 212-1 and 212-2 to the surface.

Figure 3A:
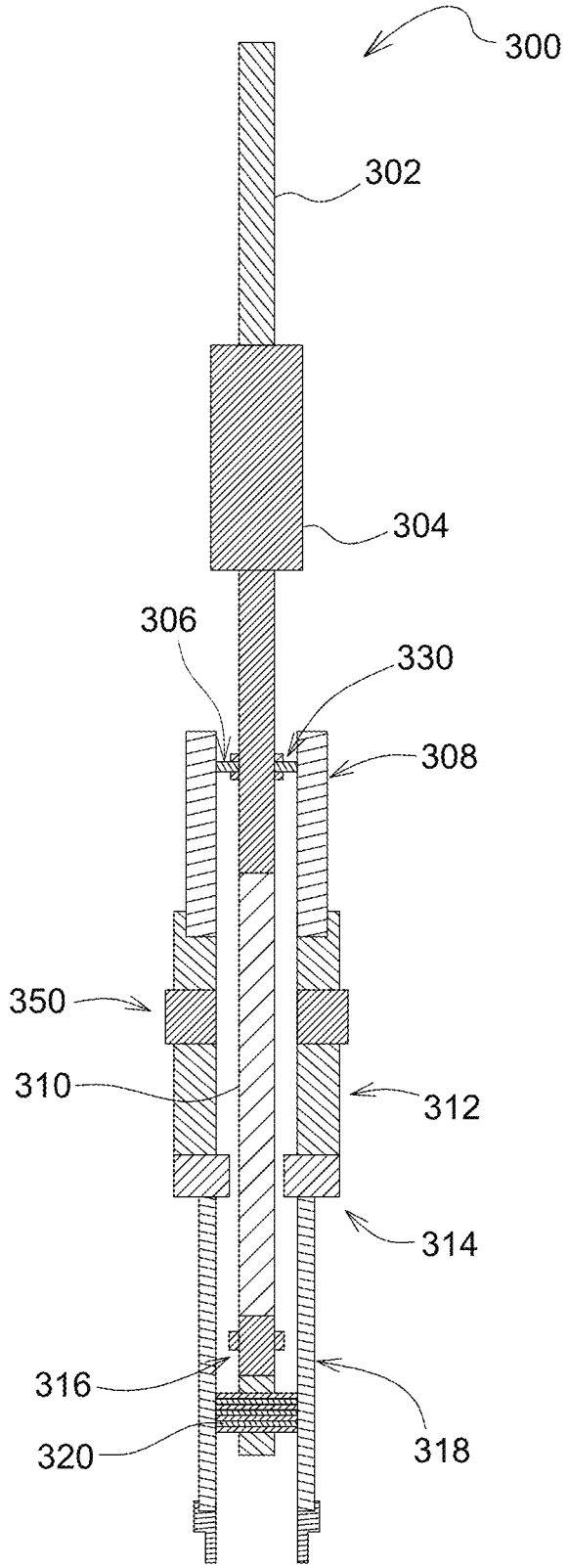
FIGS. 3A-3C illustrate an example scenario for performing DST in a single run via an inspection tool, according to certain embodiments.
Figure 3B:
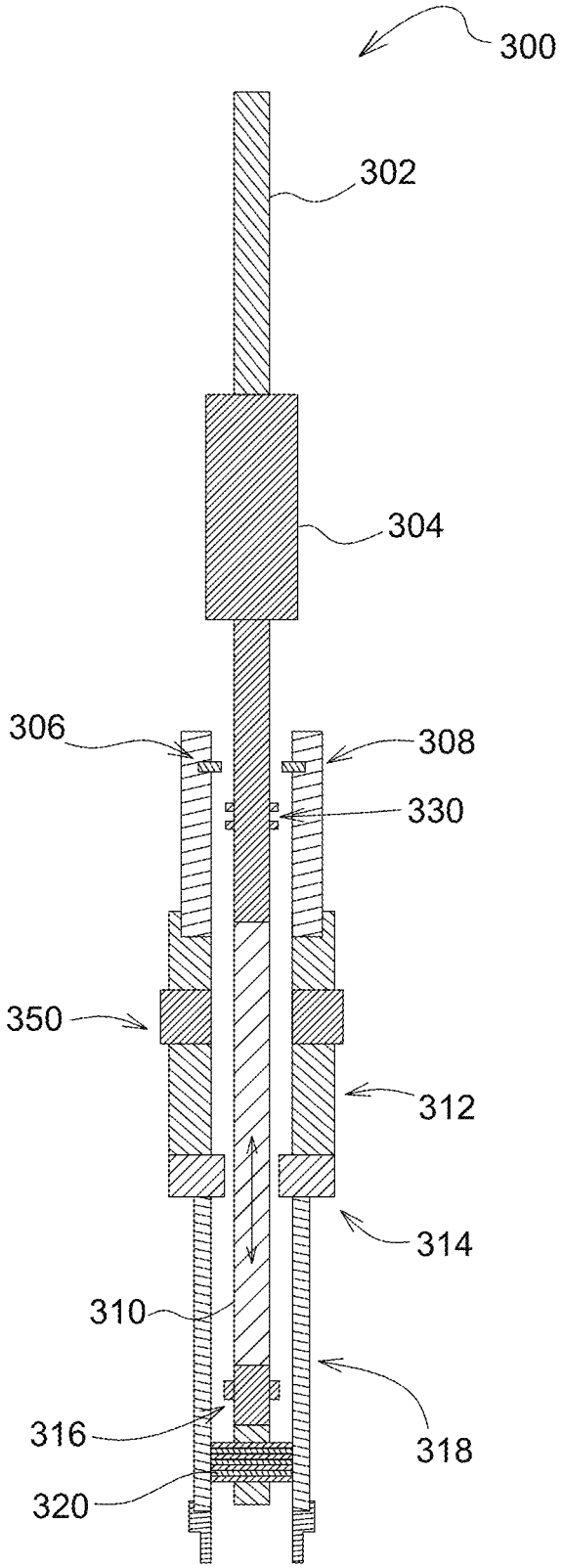
Figure 3C:
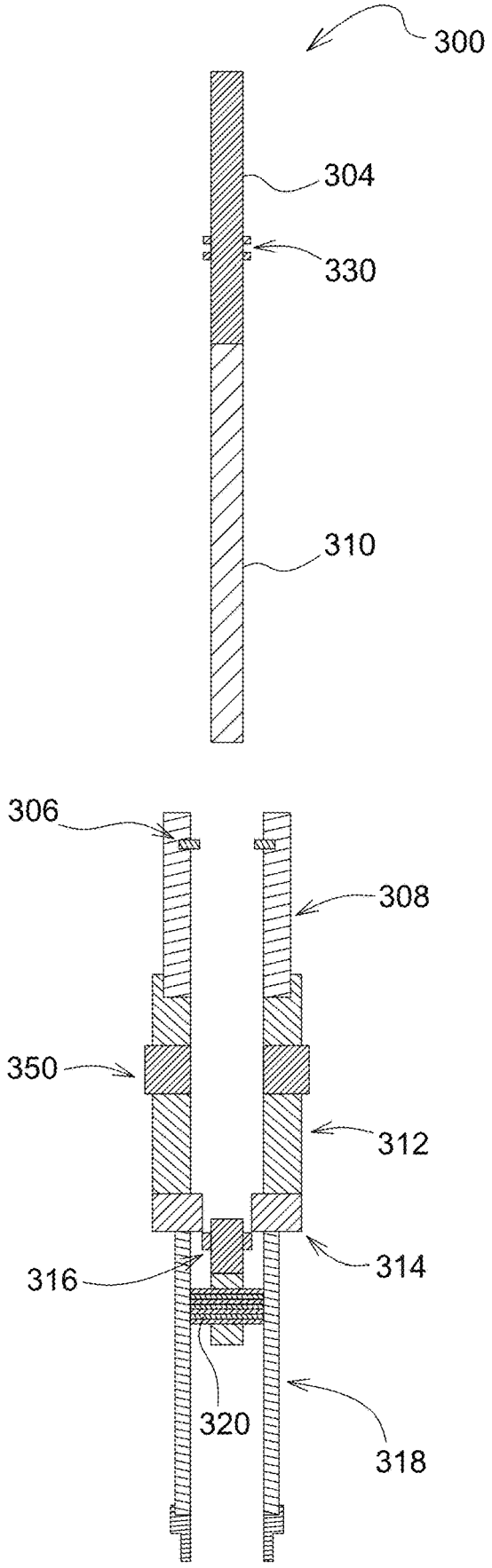

FIGS. 3A-3C illustrate an example scenario for performing DST in a single run using an inspection tool 300, according to certain embodiments. Note that each of these figures may show the inspection tool 300 during a different portion of the DST phase. The inspection tool 300 is an illustrative implementation of the inspection tool 120 illustrated in FIG. 1.

FIG. 3A illustrates the inspection tool 300 when the inspection tool 300 is lowered into a wellbore (e.g., during running in hole (RIH)). As shown in FIG. 3A, the inspection tool 300 includes a tubular member 302 and a wireless telemetry module 304 attached to the tubular member 302. The inspection tool 300 also includes a stinger 310 coupled to the tubular member 302. The stinger 310 is operable to engage with a shear release assembly 316, described further below. The wireless telemetry module 304 may be included as part of the setting tools 150 illustrated in FIG. 1. In certain embodiments, the wireless telemetry module 304 may include an electromagnetic telemetry module (e.g., electromagnetic telemetry module 212), an acoustic telemetry module (e.g., acoustic telemetry module 210), or a combination thereof.

As also illustrated in FIG. 3A, the inspection tool 300 includes a bottom hole assembly (BHA) 350 secured to the tubular member 302 via a set of locking lugs 306 attached to the BHA 350. In particular, the tubular member 302 includes at least two anchor slots (or sockets) 330 for receiving the locking lugs 306 of the BHA 350. The BHA 350 may be included as part of the setting tools 150 illustrated in FIG. 1. The BHA 350 includes, without limitation, a setting mechanism 308, a completion packer 312 coupled to one end of the setting mechanism 308, a PBR 318, and a crossover sub 314 that provides a transition between the completion packer 312 and the PBR 318. The completion packer 312 is an illustrative implementation of the completion packer 154 illustrated in FIG. 1.

As also illustrated in FIG. 3A, the BHA 350 includes a floating seal assembly 320 that is operable to mate with the PBR 318 and move axially along a length of the PBR 318. The floating seal assembly 320 is coupled to a shear release assembly 316 that allows an operator to unlatch and retrieve the stinger 310, the tubular member 302, and the wireless telemetry module 304, while leaving the BHA 350 in place for LTM.

In certain embodiments, the wireless telemetry module 304 is configured to wirelessly set the completion packer 312 during the single run. That is, the wireless telemetry module 304 is configured to wirelessly trigger the completion packer 312 to engage with a casing (e.g., casing 126) of the wellbore (e.g., wellbore 112). In certain examples, an operator (via the surface assembly 110) may transmit a (predefined) wireless signal to the wireless telemetry module 304 to trigger engagement of the completion packer 312. The wireless signal may be an acoustic wireless signal in certain embodiments.

In response to the wireless signal, the wireless telemetry module 304 may activate the setting mechanism 308. For example, the setting mechanism 308 may include a single-shot actuated pressure applicator, such as a single-shot valve or electronic rupture disk, that is activated by the wireless telemetry module 304 in response to the wireless signal. In certain cases, the activation of the single-shot actuated pressure applicator causes pressure from an annulus in the wellbore to be applied to the setting mechanism 308 to initiate the engagement of the completion packer 312 with the casing. In certain examples, the single-shot actuated pressure applicator may include an electronic rupture disk, which includes a remotely operated local actuator configured to pierce the electronic rupture disk to release the pressure from the annulus in the wellbore.

In certain embodiments, the completion packer 312 engaging with the casing creates an isolation zone within the wellbore below the completion packer 312. As illustrated in FIG. 3B, the engagement of the completion packer 312 with the casing causes the locking lugs 306 to disengage from the anchor slots 330, e.g., by laterally displacing the locking lugs 306 from the anchor slots 330. The disengagement of the locking lugs 306 from the anchor slots 330, in turn, disengages the BHA 350 from the tubular member 302, e.g., as shown in FIG. 3B. Additionally, in certain embodiments, the activation of the single-shot actuated pressure applicator decouples the stinger 310 from the setting mechanism 308, allowing the floating seal assembly 320 to float axially along the PBR 318 during the DST, e.g., as shown in FIG. 3B.

Note, in certain embodiments, the spacing of the floating seal assembly 320 within a sealbore (of the PBR 318) is completed before the inspection tool 300 is run in the wellbore, such that after unlocking of the floating seal assembly 320, no additional manipulation of the inspection tool 300 is required to prepare the floating seal assembly 320 before starting DST. As noted, a DST may be performed during the single run using LTM gauges to measure reservoir parameters, such as fluid, pressure, flow rate, permeability, fluid type, and temperature, as illustrative examples.

As shown in FIG. 3C, after the DST is completed, an operator may retrieve, during the same run, the tubular member 302, the wireless telemetry module 304, and the stinger 310, while leaving in hole the BHA 350 including the LTM gauges. For example, pulling the tubular member 302 from the surface may cause the stinger 310 to shear out from the shear release assembly 316 and allowing the tubular member 302, the wireless telemetry module 304, and the stinger 310 to be retrieved.

Example Operations

Figure 4:
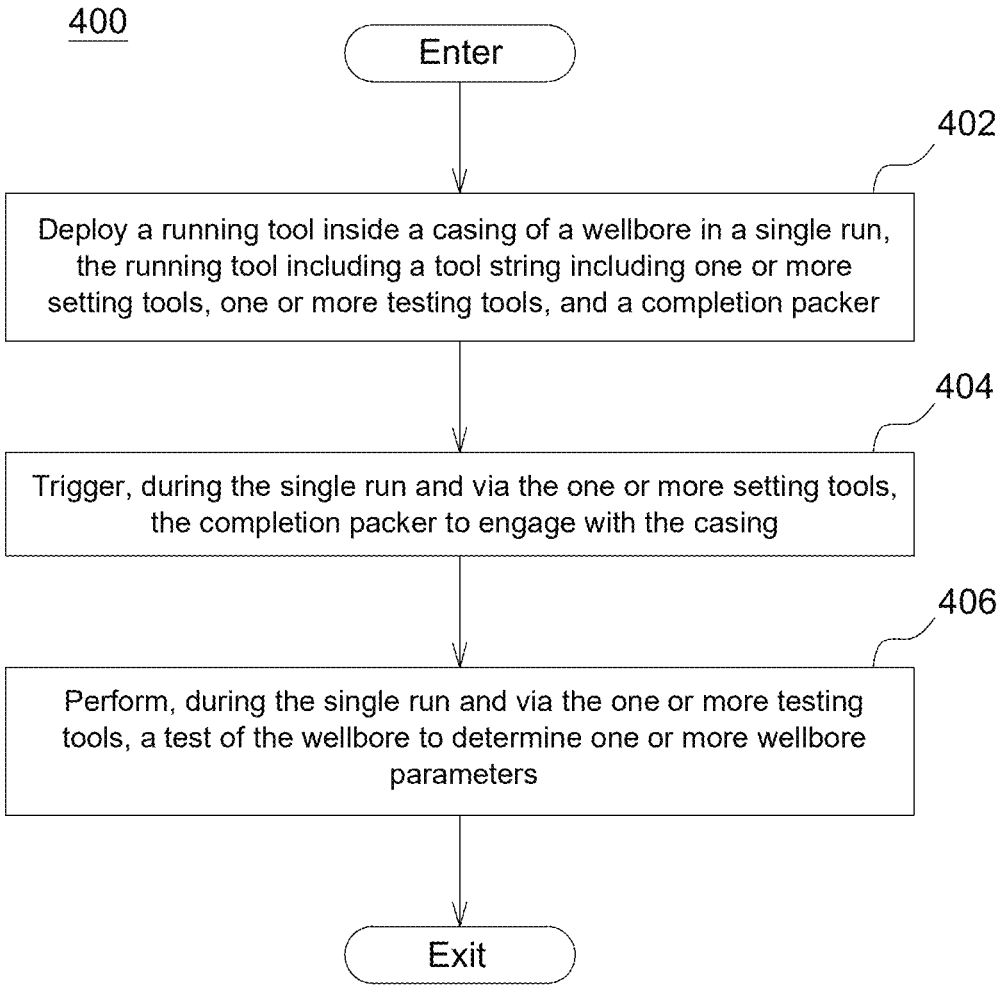
FIG. 4 is a flow diagram depicting example operations for single-run DST, according to certain embodiments.

FIG. 4 is a flow diagram depicting an example operations 400 for performing DST testing in a single run, according to certain embodiments. The operations 400 may be performed, for example, by a well system (e.g., well system 100, well system 200, etc.). In certain embodiments, the operations 400 may be performed by a processing system (e.g., processing system 114).

The operations 400 may involve, at block 402, deploying (or operating) a running tool inside a casing of a wellbore in a single run. The running tool may include a tool string that includes one or more setting tools, one or more testing tools, and a completion packer.

The operations 400 may also involve, at block 404, triggering, during the single run and via the one or more setting tools, the completion packer to engage with the casing.

The operations 400 may further involve, at block 406, performing, during the single run and via the one or more testing tools, a test of the wellbore to determine one or more wellbore parameters.

In certain embodiments, the one or more setting tools may include a wireless telemetry module. In some such embodiments, triggering the completion packer to engage with the casing may include transmitting a wireless signal to the wireless telemetry module.

In certain embodiments, the one or more setting tools may include a single-shot actuated pressure applicator and a setting mechanism. In some such embodiments, in response to the wireless signal, the wireless telemetry module may trigger activation of the single-shot actuated pressure applicator, such that pressure from an annulus in the wellbore is applied to the setting mechanism to initiate the engagement of the completion packer with the casing.

Additionally, in certain embodiments, the single-shot actuated pressure applicator may include an electronic rupture disk. In some such embodiments, the electronic rupture disk may include a remotely operated local actuator configured to pierce the electronic rupture disk to release the pressure from the annulus in the wellbore.

In certain embodiments, the one or more testing tools may include a floating seal assembly. In some such embodiments, the activation of the single-shot actuated pressure applicator may unlock the floating seal assembly once the engagement of the completion packer with the casing is completed.

In certain embodiments, a spacing of the floating seal assembly within a sealbore may be completed before the running tool is deployed in the wellbore.

In certain embodiments, the wireless telemetry module may include an acoustic telemetry module and the wireless signal may include an acoustic wireless signal.

In certain embodiments, the completion packer engaging with the casing may create an isolation zone within the wellbore below the completion packer. In some such embodiments, the operations 400 may further involve deploying, during the single run, the one or more testing tools within the isolation zone for the test of the wellbore.

In certain embodiments, the operations 400 may further involve retrieving, during the single run, at least one of the one or more setting tools, at least one of the one or more testing tools, or a combination thereof, from the wellbore. In some such embodiments, at least one of the one or more setting tools comprises a wireless telemetry module. Additionally, in some such embodiments, at least one of the one or more setting tools, the at least one of the one or more testing tools, or a combination thereof, may be retrieved from the wellbore without disengaging the completion packer from the casing.

In certain embodiments, the tool string may include a DST tool string, and the test of the wellbore may include a DST.

In certain embodiments, the one or more wellbore parameters may include at least one of a reservoir pressure, a flow rate, a permeability, a fluid type, or a temperature.

In certain embodiments, the wellbore is an onshore wellbore. In other embodiments, the wellbore is an offshore wellbore.

EXAMPLE CLAUSES

Implementation examples are described in the following numbered clauses:

Clause 1: A method of testing a wellbore, comprising: deploying a running tool inside a casing of the wellbore in a single run, the running tool comprising a tool string comprising one or more setting tools, one or more testing tools, and a completion packer; triggering, during the single run and via the one or more setting tools, the completion packer to engage with the casing; and performing, during the single run and via the one or more testing tools, a test of the wellbore to determine one or more wellbore parameters.

Clause 2: The method of Clause 1, wherein: the one or more setting tools comprise a wireless telemetry module; and triggering the completion packer to engage with the casing comprises transmitting a wireless signal to the wireless telemetry module.

Clause 3: The method of Clause 2, wherein: the one or more setting tools further comprise a single-shot actuated pressure applicator and a setting mechanism; and in response to the wireless signal, the wireless telemetry module triggers activation of the single-shot actuated pressure applicator, such that pressure from an annulus in the wellbore is applied to the setting mechanism to initiate the engagement of the completion packer with the casing.

Clause 4: The method of Clause 3, wherein: the single-shot actuated pressure applicator comprises an electronic rupture disk; and the electronic rupture disk comprises a remotely operated local actuator configured to pierce the electronic rupture disk to release the pressure from the annulus in the wellbore.

Clause 5: The method in accordance with any of Clauses 3-4, wherein: the one or more testing tools comprise a floating seal assembly; and the activation of the single-shot actuated pressure applicator unlocks the floating seal assembly once the engagement of the completion packer with the casing is completed.

Clause 6: The method of Clause 5, wherein a spacing of the floating seal assembly within a sealbore is completed before the running tool is deployed in the wellbore.

Clause 7: The method in accordance with any of Clauses 2-6, wherein: the wireless telemetry module comprises an acoustic telemetry module; and the wireless signal comprises an acoustic wireless signal.

Clause 8: The method in accordance with any of Clauses 1-7, wherein the completion packer engaging with the casing creates an isolation zone within the wellbore below the completion packer, the method further comprising deploying, during the single run, the one or more testing tools within the isolation zone for the test of the wellbore.

Clause 9: The method in accordance with any of Clauses 1-8, further comprising retrieving, during the single run, at least one of the one or more setting tools, at least one of the one or more testing tools, or a combination thereof, from the wellbore.

Clause 10: The method of Clause 9, wherein the at least one of the one or more setting tools comprises a wireless telemetry module.

Clause 11: The method in accordance with any of Clauses 9-10, wherein the at least one of the one or more setting tools, the at least one of the one or more testing tools, or a combination thereof, are retrieved from the wellbore without disengaging the completion packer from the casing.

Clause 12: The method in accordance with any of Clauses 1-11, wherein: the tool string comprises a drill stem testing tool string; and the test of the wellbore comprises drill stem testing.

Clause 13: The method in accordance with any of Clauses 1-12, wherein the one or more wellbore parameters comprise at least one of a reservoir pressure, a flow rate, a permeability, a fluid type, or a temperature.

Clause 14: The method in accordance with any of Clauses 1-13, wherein the wellbore is an onshore wellbore.

Clause 15: The method in accordance with any of Clauses 1-13, wherein the wellbore is an offshore wellbore.

Clause 16: A system comprising: one or more memories collectively storing instructions; and one or more processors communicatively coupled to the one or more memories, the one or more processors being collectively configured to execute the instructions to cause the system to: operate a running tool inside a casing of a wellbore in a single run, the running tool comprising a tool string comprising one or more setting tools, one or more testing tools, and a completion packer; trigger, during the single run and via the one or more setting tools, the completion packer to engage with the casing; and perform, during the single run and via the one or more testing tools, a test of the wellbore to determine one or more wellbore parameters.

Clause 17: The system of Clause 16, wherein: the one or more setting tools comprise a wireless telemetry module; and to trigger the completion packer to engage with the casing, the one or more processors are collectively configured to execute the instructions to cause the system to transmit a wireless signal to the wireless telemetry module.

Clause 18: The system of Clause 17, wherein: the one or more setting tools further comprise a single-shot actuated pressure applicator and a setting mechanism; and in response to the wireless signal, the wireless telemetry module triggers activation of the single-shot actuated pressure applicator, such that pressure from an annulus in the wellbore is applied to the setting mechanism to initiate the engagement of the completion packer with the casing.

Clause 19: The system of Clause 18, wherein: the single-shot actuated pressure applicator comprises an electronic rupture disk; and the electronic rupture disk comprises a remotely operated local actuator configured to pierce the electronic rupture disk to release the pressure from the annulus in the wellbore.

Clause 20: A non-transitory computer-readable storage medium comprising computer-executable code, which when executed by one or more processors of a computing system, perform an operation comprising: operating a running tool inside a casing of a wellbore in a single run, the running tool comprising a tool string comprising one or more setting tools, one or more testing tools, and a completion packer; triggering, during the single run and via the one or more setting tools, the completion packer to engage with the casing; and performing, during the single run and via the one or more testing tools, a test of the wellbore to determine one or more wellbore parameters.

Clause 21: A non-transitory computer-readable storage medium comprising computer-executable code, which when executed by one or more processors of a downhole telemetry module, perform a method in accordance with any of Clauses 1-15.

Clause 22: An apparatus comprising means for performing a method in accordance with any of Clauses 1-15.

Clause 23: An apparatus comprising: one or more memories collectively storing computer-executable instructions, and one or more processors coupled to the one or more memories, the one or more processors being collectively configured to execute the computer-executable instructions to cause the apparatus to perform a method in accordance with any of Clauses 1-15.

ADDITIONAL CONSIDERATIONS

The preceding description is provided to enable any person skilled in the art to practice the various aspects described herein. The examples discussed herein are not limiting of the scope, applicability, or aspects set forth in the claims. Various modifications to these aspects will be readily apparent to those skilled in the art, and the general principles defined herein may be applied to other aspects. For example, changes may be made in the function and arrangement of elements discussed without departing from the scope of the disclosure. Various examples may omit, substitute, or add various procedures or components as appropriate. For instance, the methods described may be performed in an order different from that described, and various actions may be added, omitted, or combined. Also, features described with respect to some examples may be combined in some other examples. For example, an apparatus may be implemented or a method may be practiced using any number of the aspects set forth herein. In addition, the scope of the disclosure is intended to cover such an apparatus or method that is practiced using other structure, functionality, or structure and functionality in addition to, or other than, the various aspects of the disclosure set forth herein. It should be understood that any aspect of the disclosure disclosed herein may be embodied by one or more elements of a claim.

The various illustrative logical blocks, modules and circuits described in connection with the present disclosure may be implemented or performed with a general purpose processor, a digital signal processor (DSP), an application specific integrated circuit (ASIC), a field programmable gate array (FPGA) or other programmable logic device (PLD), discrete gate or transistor logic, discrete hardware components, or any combination thereof designed to perform the functions described herein. A general-purpose processor may be a microprocessor, but in the alternative, the processor may be any commercially available processor, controller, microcontroller, or state machine. A processor may also be implemented as a combination of computing devices, e.g., a combination of a DSP and a microprocessor, a plurality of microprocessors, one or more microprocessors in conjunction with a DSP core, a system on a chip (SoC), or any other such configuration.

As used herein, a phrase referring to "at least one of" a list of items refers to any combination of those items, including single members. As an example, "at least one of: a, b, or c" is intended to cover a, b, c, a-b, a-c, b-c, and a-b-c, as well as any combination with multiples of the same element (e.g., a-a, a-a-a, a-a-b, a-a-c, a-b-b, a-c-c, b-b, b-b-b, b-b-c, c-c, and c-c-c or any other ordering of a, b, and c).

As used herein, "a processor," "at least one processor," or "one or more processors" generally refer to a single processor configured to perform one or multiple operations or multiple processors configured to collectively perform one or more operations. In the case of multiple processors, performance of the one or more operations could be divided amongst different processors, though one processor may perform multiple operations, and multiple processors could collectively perform a single operation. Similarly, "a memory," "at least one memory," or "one or more memories" generally refer to a single memory configured to store data and/or instructions or multiple memories configured to collectively store data and/or instructions.

As used herein, the term "determining" encompasses a wide variety of actions. For example, "determining" may include calculating, computing, processing, deriving, investigating, looking up (e.g., looking up in a table, a database or another data structure), ascertaining and the like. Also, "determining" may include receiving (e.g., receiving information), accessing (e.g., accessing data in a memory) and the like. Also, "determining" may include resolving, selecting, choosing, establishing and the like.

The methods disclosed herein comprise one or more actions for achieving the methods. The method actions may be interchanged with one another without departing from the scope of the claims. In other words, unless a specific order of actions is specified, the order and/or use of specific actions may be modified without departing from the scope of the claims. Further, the various operations of methods described above may be performed by any suitable means capable of performing the corresponding functions. The means may include various hardware and/or software component(s) and/or module(s), including, but not limited to a circuit, an ASIC, or processor.

The following claims are not intended to be limited to the aspects shown herein, but are to be accorded the full scope consistent with the language of the claims. Within a claim, reference to an element in the singular is not intended to mean "one and only one" unless specifically so stated, but rather "one or more." Unless specifically stated otherwise, the term "some" refers to one or more. No claim element is to be construed under the provisions of 35 U.S.C. § 112(f) unless the element is expressly recited using the phrase "means for". All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims.

The invention claimed is:

1. A method of testing a wellbore, the method comprising:

deploying a running tool inside a casing of the wellbore in a single run, the running tool comprising a tool string including:

(i) one or more downhole testing tools;

(ii) a completion packer;

(iii) a wireless telemetry module; and (iv) a pressure-actuated setting tool operably coupled to the completion packer:

transmitting, during the single run, a wireless command from a surface location to the wireless telemetry module;

in response to the wireless command, actuating, during the single run, the pressure-actuated setting tool to apply annulus pressure to set the completion packer to engage with the casing;

after setting the completion packer, performing, during the single run and via the one or more downhole testing tools, a drill stem test of a formation isolated by the completion packer to determine one or more wellbore parameters; and after completion of the drill stem test, retrieving at least the wireless telemetry module from the wellbore while leaving the completion packer set within the casing.

2. The method of claim 1, wherein the pressure-actuated setting tool comprises:

an electronic rupture disk; and a remotely operated local actuator configured to pierce the electronic rupture disk to release the pressure from the annulus in the wellbore.

3. The method of claim 1, wherein:

the running tool further comprises a floating seal assembly; and the actuation of the pressure-actuated setting tool permits axial movement of the floating seal assembly once the engagement of the completion packer with the casing is completed.

4. The method of claim 3, wherein the floating seal assembly is positioned within a sealbore prior to deployment of the running tool.

5. The method of claim 1, wherein the wellbore is an offshore wellbore.

6. The method of claim 1, wherein:

the completion packer engaging with the casing creates an isolation zone within the wellbore below the completion packer; and the method further comprises deploying, during the single run, the one or more downhole testing tools within the isolation zone for the drill stem test of the wellbore.

7. The method of claim 1, further comprising, after completion of the drill stem test, retrieving the wireless telemetry module from the wellbore while leaving the completion packer set within the casing.

8. The method of claim 1, wherein the one or more wellbore parameters comprise at least one of a reservoir pressure, a flow rate, a permeability, a fluid type, or a temperature.

9. The method of claim 1, wherein the wellbore is an onshore wellbore.

10. The method of claim 1, wherein:

the wireless telemetry module comprises an acoustic telemetry module; and the wireless command comprises an acoustic wireless signal.

11. The method of claim 10, wherein:

the acoustic telemetry module is coupled to an electromagnetic telemetry module to form a long term monitoring module;

the method further comprises transmitting, after the drill stem test is completed, electromagnetic signals from the electromagnetic telemetry module, along an intact casing string, to the surface location.

12. The method of claim 10, wherein the running tool further comprises:

a tubular member extending vertically through the running tool, the tubular member including anchor slots;

a stinger coupled to the tubular member and operable to engage with a shear release assembly; and a bottom hole assembly secured to the tubular member via a set of locking lugs received within the anchor slots of the tubular member.

13. The method of claim 12, wherein:

actuating the pressure-actuated setting tool to apply annulus pressure to set the completion packer to engage with the casing causes the locking lugs to disengage from the anchor slots by laterally displacing the locking lugs from the anchor slots to disengage the bottom hole assembly from the tubular member; and actuation of the pressure-actuated setting tool decouples the stinger from the pressure-actuated setting tool.

14. The method of claim 12, wherein:

a floating seal assembly is positioned within a sealbore of a polished bore receptacle;

the floating seal assembly is coupled to the shear release assembly;

the actuation of the pressure-actuated setting tool permits axial movement of the floating seal assembly along the polished bore receptacle during the drill stem test; and a crossover sub provides a transition between the completion packer and the polished bore receptacle.

15. The method of claim 14, wherein retrieving at least the wireless telemetry module from the wellbore while leaving the completion packer set within the casing comprises retrieving the tubular member, the wireless telemetry module, and the stinger from the wellbore by shearing the stinger from the shear release assembly, while leaving the completion packer, the pressure-actuated setting tool, the crossover sub, the polished bore receptacle, and the floating seal assembly in place within the wellbore and without disengaging the completion packer from the casing.

* * * * *